US007853032B2

(12) United States Patent
Heerlein et al.

(10) Patent No.: US 7,853,032 B2
(45) Date of Patent: Dec. 14, 2010

(54) AUDIO SHOE CONTACT FOR A HEARING DEVICE

(75) Inventors: Markus Heerlein, Singapore (SG); Wai Kit David Ho, Singapore (SG); Thomas Kasztelan, Singapore (SG)

(73) Assignee: Siemens Audiologische Technik GmbH, Erlangen (DE)

( * ) Notice: Subject to any disclaimer, the term of this patent is extended or adjusted under 35 U.S.C. 154(b) by 1142 days.

(21) Appl. No.: 11/512,306

(22) Filed: Aug. 29, 2006

(65) Prior Publication Data

US 2007/0047751 A1 Mar. 1, 2007

(30) Foreign Application Priority Data

Aug. 31, 2005 (DE) ..... 10 2005 041 356

(51) Int. Cl.
*H04R 25/00* (2006.01)

(52) U.S. Cl. ..... 381/322; 381/323

(58) Field of Classification Search ..... 381/312, 381/314, 322, 323, 324
See application file for complete search history.

(56) References Cited

U.S. PATENT DOCUMENTS

| | | | |
|---|---|---|---|
| 4,539,439 | A | 9/1985 | Strothmann et al. |
| 4,964,170 | A | 10/1990 | Pohacker |
| 5,188,540 | A | 2/1993 | Haertl et al. |
| 6,456,720 | B1 | 9/2002 | Brimhall et al. |
| 2001/0043709 | A1 | 11/2001 | Panitzsch |
| 2004/0062409 | A1 | 4/2004 | Batting |
| 2006/0126875 | A1 | 6/2006 | Kragelund |
| 2007/0019834 | A1 * | 1/2007 | Nielson ..... 381/328 |

FOREIGN PATENT DOCUMENTS

| | | | |
|---|---|---|---|
| CH | 673740 | A5 | 3/1990 |
| CH | 673743 | A5 | 3/1990 |
| CH | 675657 | A5 | 10/1990 |
| DE | 279365 | A1 | 5/1990 |
| DE | 41 09 306 | C1 | 7/1992 |
| DE | 9306204 | U1 | 8/1993 |
| DE | 29819993 | U1 | 2/1999 |
| DE | 10023907 | A1 | 11/2001 |
| EP | 0334 837 | B1 | 9/1989 |
| EP | 0362189 | A2 | 4/1990 |
| EP | 0806885 | A1 | 11/1997 |
| EP | 1317163 | A2 | 6/2003 |
| EP | 1 346 602 | B1 | 9/2003 |
| WO | WO 2004/112431 | A1 | 12/2004 |

OTHER PUBLICATIONS

Markus Heerlein, "Audioschuhkontakt direkt auf PCB", Jul. 1, 2005, pp. 1-5, Siemens AG.

* cited by examiner

*Primary Examiner*—Tuan D Nguyen

(57) ABSTRACT

A hearing device with an audio shoe is to be designed in a simpler and less interference-susceptible manner. To this end, provision is made for an audio shoe to comprise contact springs of such type that directly contact the circuit boards of a hearing device. A contact intermediate piece between the audio shoe and the circuit board of the hearing device can thus be dispensed with. Furthermore, contact problems caused by the intermediate piece can hereby be avoided and the assembly cost for the hearing device reduced.

9 Claims, 2 Drawing Sheets

AUDIO SHOE CONTACT FOR A HEARING DEVICE

CROSS REFERENCE TO RELATED APPLICATIONS

This application claims priority of German application No. 10 2005 041 356.0 filed Aug. 31, 2005, which is incorporated by reference herein in its entirety.

FIELD OF THE INVENTION

The present invention relates to a hearing device with a printed circuit board, which is equipped with electronic signal processing elements and comprises the at least one connector pad for an audio shoe, and an audio shoe which comprises at least one contact spring for connection to the circuit board.

BACKGROUND OF THE INVENTION

Numerous hearing devices are able to inject audio signals via a special audio shoe. For this purpose, an external audio device is plugged into the audio shoe. The audio shoe then forms the interface between the hearing device and the external audio device.

An audio shoe usually features a number of contacts, e.g. four, which must be contacted with corresponding connections on the circuit board of the hearing device. As the circuit board is usually located in the center region of the hearing device housing, whereas the audio shoe is plugged into or arranged on the end (battery compartment end) opposite to the receiver, a special intermediate piece is needed to connect the contacts of these two elements. An intermediate piece ZS of this type is shown in FIG. 1. It is contacted on the circuit board LP, which is equipped with components for signal processing purposes.

The intermediate piece ZS is mostly realized as an injection molding part. Metal contacts MK are injected or molded into the intermediate piece ZS, said metal contacts then lying on the exterior of the hearing device. These contacts often corrode, thereby resulting in contact problems between the circuit board LP and an audio shoe not shown in FIG. 1. For this reason, special cover flaps are generally required for the audio shoe. A further disadvantage of the separate intermediate piece ZS is that said separate part causes the assembly time for a hearing device to increase.

Patent specification DE 41 09 306 C1 describes a hearing device with electrical contact means arranged in a battery compartment. An external programming device can thus be connected to a programmable hearing device element.

European patent specification EP 0 334 837 B1 further presents a hearing device with an audio shoe. Contact springs located in the audio shoe create contact with the housing screws of the hearing device.

Furthermore, the publications WO 2004/112431 A1, EP 1 346 602 B1 and CH 675 657 A5 each disclose hearing devices with a detachable audio shoe. The contacts of the audio shoe are connected to corresponding mating contacts on the hearing device housing.

SUMMARY OF THE INVENTION

The object of the present invention is thus to simplify the assembly of a hearing device, to which an audio shoe can be connected and to reduce the susceptibility to interference of the contact between the audio shoe and the circuit board.

In accordance with the invention, this object is achieved by a hearing device with a printed circuit board, which is equipped with electronic signal processing elements and which comprises at least one connector pad for an audio shoe, and an audio shoe, which comprises at least one contact spring for connection to the circuit board, with the at least one contact spring being designed such that it directly touches the at least one connector pad.

Advantageously, the special contact spring(s) can dispense with an expensive plastic part provided with conductor paths. Corrosion problems thus also do not apply, which otherwise occur with the conventional intermediate pieces. Furthermore, the relatively complex assembly step is dispensed with whereby conductor paths for the audio shoe must be soldered onto the circuit board of the hearing device in order to increase the contact reliability between these two components.

The audio shoe preferably comprises a battery retaining facility and can be at least partially plugged into a battery compartment of the hearing device. A stable mechanical connection between the hearing device and the audio shoe can hereby be achieved.

The at least one contact spring is advantageously supported by the battery retaining facility. The contact springs hereby ensure an adequate contact force against the circuit board of the hearing device, despite their relatively large length.

The at least one contact spring can be partially molded into the battery retaining facility. The contact springs can hereby be very effectively stabilized in their position.

Furthermore, the audio shoe can represent a cover of the battery compartment of the hearing device. A separate cover can thus be dispensed with if an audio shoe is used.

In a particularly favorable embodiment, the audio shoe is permanently installed onto the hearing device. The user can thus always connect an external audio device to his/her hearing device without having to keep a special adapter ready or look for one.

BRIEF DESCRIPTION OF THE DRAWINGS

The present invention is now described in more detail below with reference to the appended drawings, in which.

DETAILED DESCRIPTION OF THE INVENTION

The exemplary embodiment described in more detail below represents a preferred embodiment of the present invention.

Figure 1:
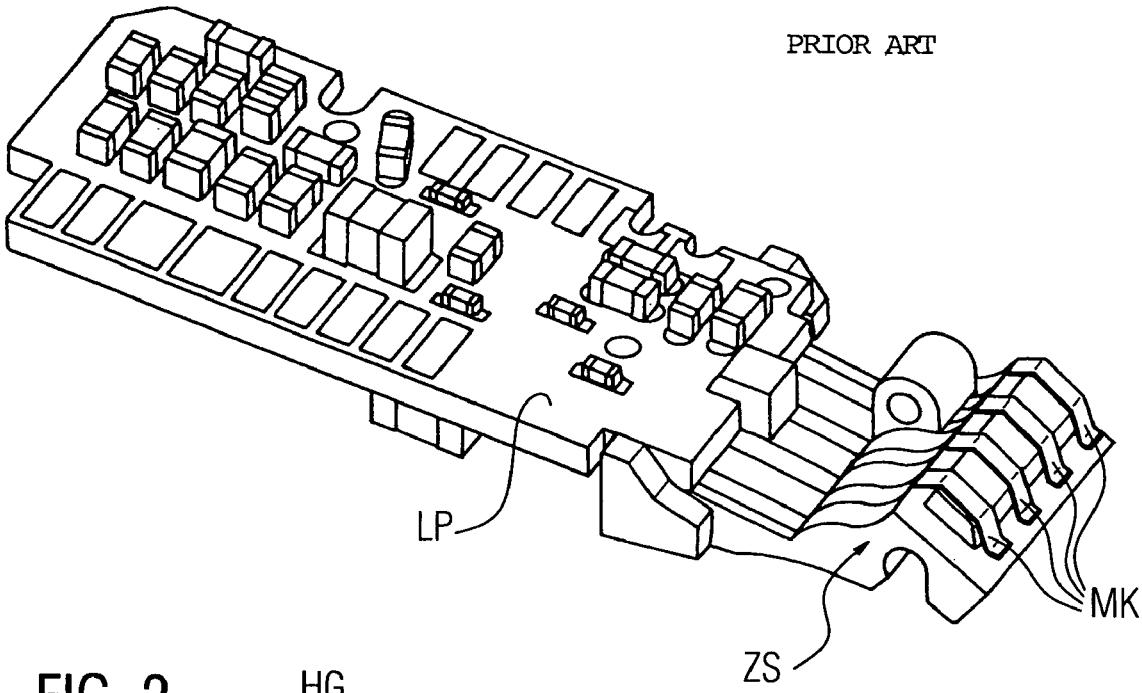
FIG. 1 shows a view of a circuit board with an intermediate piece for contacting an audio shoe according to the prior art
Figure 2:
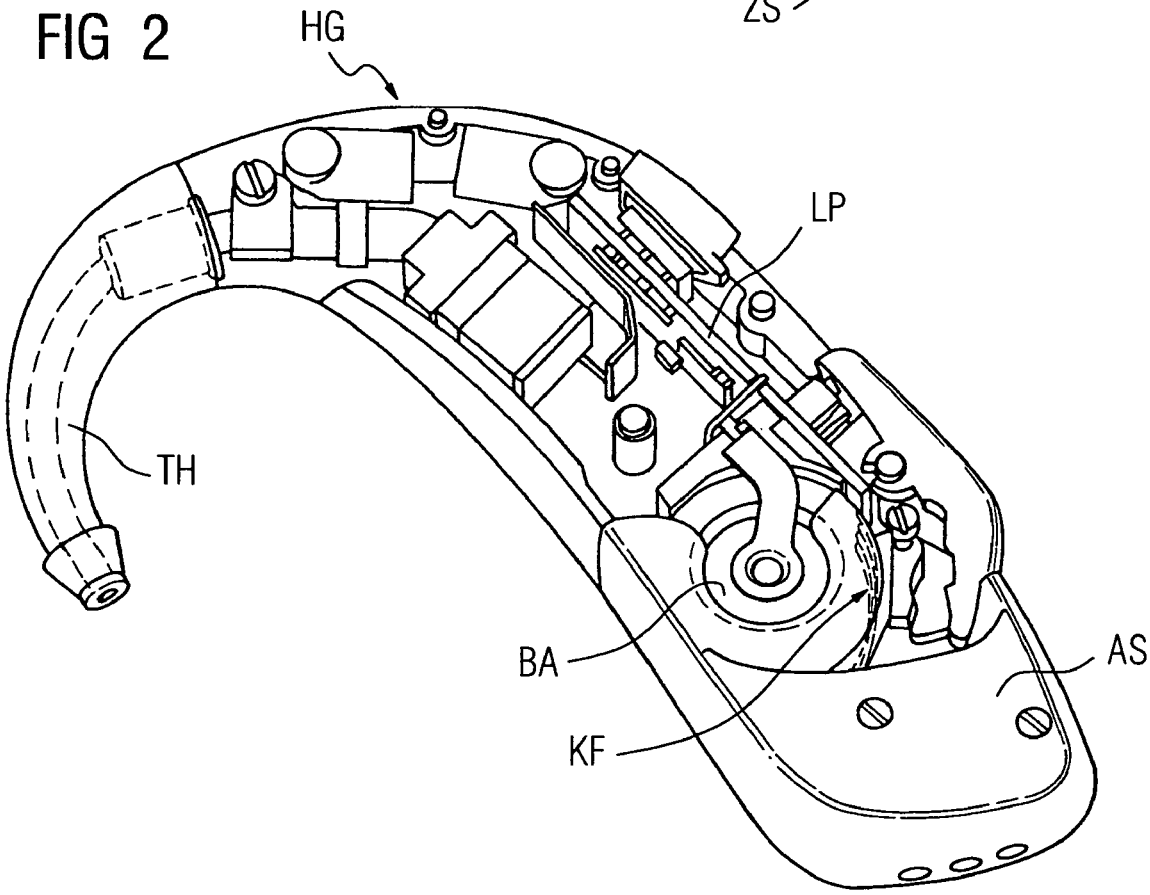
FIG. 2 shows a hearing device with an audio shoe according to the invention

According to FIG. 2, an inventive behind-the-ear hearing device HG is equipped with an audio shoe AS on the end facing away from the frog stud TH. Furthermore, a battery BA and a printed circuit board LP can be seen in the image in FIG. 2. Contact springs KF create the contact between the audio shoe AS and the printed circuit board LP.

The audio shoe is thus directly assembled and/or integrated into the hearing device housing. This means that the audio shoe cannot be accommodated in and detached from the hearing device as is otherwise usual. In an alternative embodiment, the audio shoe can naturally still be realized in a pluggable fashion. In both cases, the hearing device can be operated in standard mode or in audio shoe mode.

Figure 3:
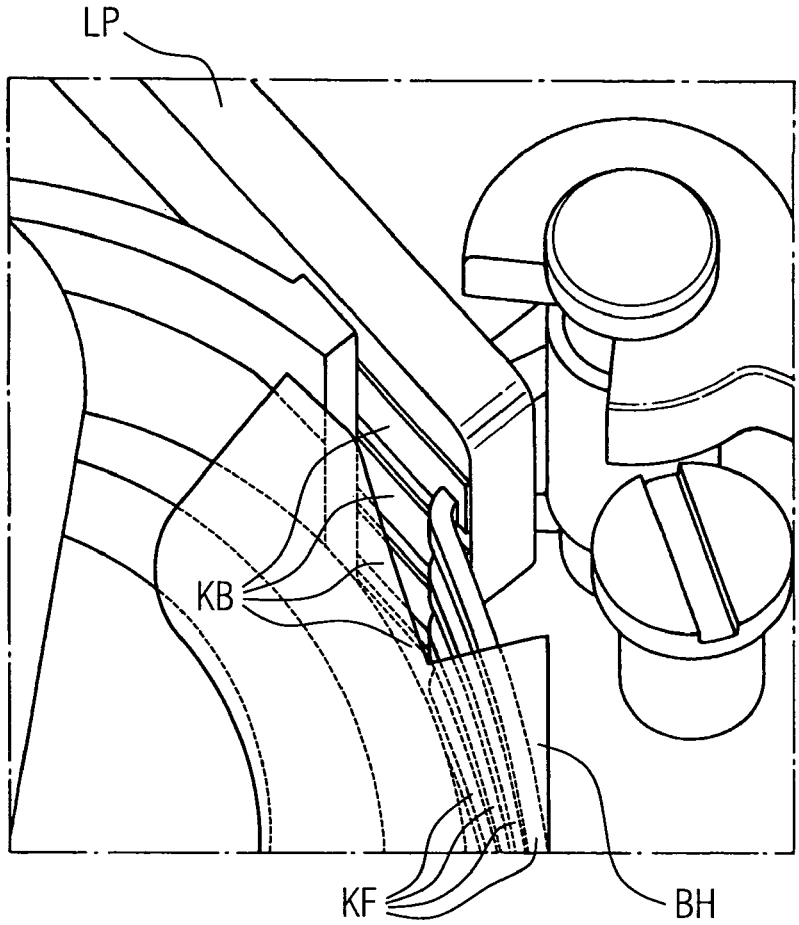
FIG. 3 shows a detailed view of the connection region of the contact springs with a circuit board.

In FIG. 3, the section of FIG. 2 is shown enlarged, which illustrates the connection region between the contact springs KF and the circuit board LP. Only three out of the four contact springs can be directly identified in the Figure. A fourth contact spring can be identified schematically in the background. The contact springs KF are molded into a battery retaining segment BH. The springy segment of the relatively long contact springs (see FIG. 2) is thus kept short, so that a correspondingly high spring force can be achieved at the end of the contact springs KF.

Four contact regions KB, so-called contact pads, are provided on the underside of the circuit board LP. Only three of the four contact regions can be identified in FIG. 3, and the position of the fourth is only indicated by a reference line.

After mounting the audio shoe AS onto the hearing device HG, the four contact springs KF of the audio shoe AS each indirectly press on the respective contact regions KB of the circuit board. This allows a special intermediate piece between the audio shoe AS and the circuit board LP to be dispensed with, which, as the case may be, causes contact problems.

Figure 4:
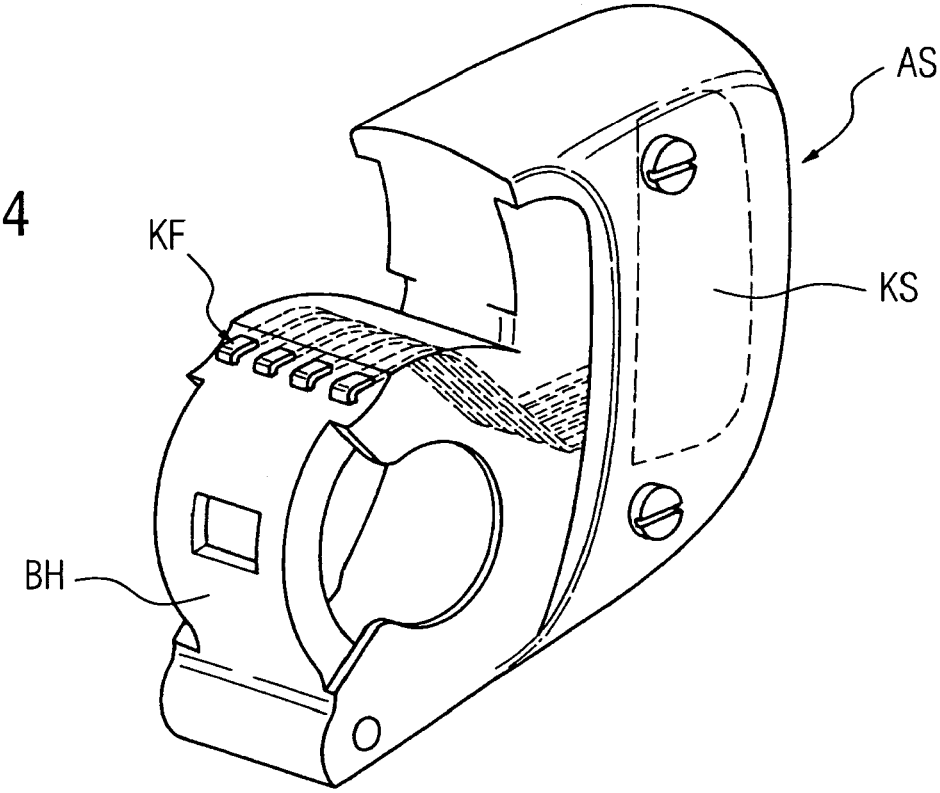
FIG. 4 shows a 3D view of an audio shoe according to the invention.

FIG. 4 shows the audio shoe AS in a state removed from the hearing device HG. The audio shoe AS is made of a plastic shape which is composed inter alia of the battery holder BH. The four contact springs KF are partially molded into the battery retainer, with their ends remaining free.

The battery retainer BH is inserted into the battery compartment of the hearing device when the audio shoe is assembled onto the hearing device. The audio shoe AS and/or the part of the audio shoe with the contact interface KS then forms the battery compartment lid. The audio shoe according to the invention thus combines the four functionalities (audio shoe, intermediate piece, battery retainer and battery compartment cover) as shown in FIG. 4.

The invention claimed is:

1. A hearing device, comprising:

a printed circuit board which comprises an electronic signal processing element and a connector pad; and an audio shoe which comprises a contact spring directly touching the connector pad for directly connecting the audio shoe to the circuit board.

2. The hearing device as claimed in claim 1, wherein the audio shoe comprises a battery retainer.

3. The hearing device as claimed in claim 2, wherein the battery retainer is partially plugged into a battery compartment of the hearing device.

4. The hearing device as claimed in claim 3, wherein the audio shoe is a cover of the battery compartment of the hearing device.

5. The hearing device as claimed in claim 2, wherein the contact spring is supported by the battery retainer.

6. The hearing device as claimed in claim 5, wherein the contact spring is partially molded into the battery retainer.

7. The hearing device as claimed in claim 1, wherein the audio shoe is permanently installed onto the hearing device.

8. The hearing device as claimed in claim 1, wherein the audio shoe is plugged into the hearing device.

9. A method for a hearing device, comprising:

arranging a printed circuit board comprising an electronic signal processing element and a connector pad;

arranging an audio shoe comprising a contact spring directly touching the connector pad; and directly connecting the audio shoe to the circuit board via the contact spring.

* * * * *